US007607425B2

(12) United States Patent
Knight

(10) Patent No.: US 7,607,425 B2
(45) Date of Patent: Oct. 27, 2009

(54) COLLAPSIBLE HEATING DEVICE

(75) Inventor: Leo Donald Knight, 5215 Sandhills Dr., Kelowna, British Columbia (CA) V1X 7Y7

(73) Assignee: Leo Donald Knight, Kelowna (CA)

( * ) Notice: Subject to any disclaimer, the term of this patent is extended or adjusted under 35 U.S.C. 154(b) by 436 days.

(21) Appl. No.: 11/208,172

(22) Filed: Aug. 22, 2005

(65) Prior Publication Data

US 2005/0274372 A1 Dec. 15, 2005

Related U.S. Application Data

(63) Continuation-in-part of application No. 10/624,973, filed on Jul. 23, 2003, now abandoned.

(60) Provisional application No. 60/400,371, filed on Aug. 2, 2002.

(51) Int. Cl.
*A47J 37/07* (2006.01)

(52) U.S. Cl. ..... 126/9 R; 126/9 B; 126/30; 126/50; 126/43

(58) Field of Classification Search ..... 126/9 R, 126/9 B, 30, 50, 43
See application file for complete search history.

(56) References Cited

U.S. PATENT DOCUMENTS

| | | | | | |
|---|---|---|---|---|---|
| 3,667,446 | A | | 6/1972 | Morton | |
| 3,765,397 | A | * | 10/1973 | Henderson | 126/25 R |
| 4,909,235 | A | * | 3/1990 | Boetcker | 126/9 R |
| 5,094,223 | A | | 3/1992 | Gonzalez | |
| 5,163,415 | A | | 11/1992 | Moncrief et al. | |
| 5,744,106 | A | * | 4/1998 | Eagle | 422/306 |
| 6,029,650 | A | * | 2/2000 | Treants | 126/204 |

* cited by examiner

*Primary Examiner*—Steven B McAllister
*Assistant Examiner*—Nikhil Mashruwala

(57) ABSTRACT

A collapsible heating device for building a fire using solid fuel is disclosed wherein the heating device includes a canister defining a hollow cavity, the canister having an open end. A base corresponding to the canister is configured to mate with the open end so as to detachably close the open end. A perforated lower burner defining a hollow core is supported on the base. A perforated upper burner defining a hollow core is removably nestable within the lower burner. The upper burner is movable between a first collapsed position, wherein the upper burner is disposed within the lower burner, and a second operative position, wherein the upper burner is supported upright on the lower burner. When the upper burner is in the first collapsed position, the canister may mate with the base to extinguish the fire.

20 Claims, 10 Drawing Sheets

COLLAPSIBLE HEATING DEVICE

CROSS REFERENCE TO RELATED APPLICATIONS

This application claims priority from U.S. patent application Ser. No. 10/624,973 filed Jul. 23, 2003 entitled PORTABLE CAMPFIRE IN A CAN which claims priority from U.S. Provisional Application No. 60/400,371 filed Aug. 2, 2002 entitled PORTABLE CAMPFIRE IN A CAN.

FIELD OF INVENTION

This invention relates to the field of outdoors equipment and more particularly, it relates to a collapsible heating device.

BACKGROUND

Traditional outdoor heating devices such as campfires may be dangerous to operate as they are usually not self contained. Campfires also generally require an ample amount of solid fuel such as firewood to generate and provide sufficient heat for warmth and/or cooking due to the low burn efficiency of a campfire. More particularly, if the firewood is packed too closely together, insufficient air will be available for complete combustion, causing loss of heat energy, and if the firewood is spaced too far apart, sufficiently high temperatures may be difficult to obtain and maintain because too much air will cool the fire and reduce its efficiency. Furthermore, the ability to build and maintain a campfire also requires considerable skill and effort. For example, to effectively build a campfire, one must be able to identify and gather appropriate kindling material and dry firewood, build a pyramid-like structure over the kindling material using smaller sticks, successfully start burning the kindling material and smaller sticks, and add increasingly larger sticks and firewood as the fire grows in strength while leaving enough space between them for the fire to breathe.

Other outdoor heating devices such as various conventional cook stoves that use a solid fuel source, including but not limited to charcoal burning barbecue and hibachi type stoves, provide a self contained portable heat source as well as a means for cooking. However, because charcoal burns with a low rate of heat output, such prior art heating devices require a substantial amount of fuel to generate the desired amount of heat. Typically, a voluminous amount of charcoal briquettes is stacked upon each other, reducing the available surface area and airflow required for an efficient burn. Furthermore, because charcoal burns at a low rate of combustion, which means that a charcoal bed will burn a long time, such prior art heating devices fail to provide a convenient means of extinguishing the fire without necessitating dumping of the charcoals or waiting for the charcoals to burn out on their own.

Applicant is aware of U.S. Pat. No. 3,765,397 to Henderson which provides a portable and nestable stove having two housings defining a first chamber and a larger second chamber, respectively, each of the housings having a tapered wall configuration extending between a larger open end and smaller open end. A grate, a rack, and one or more draft openings are provided in each housing with the smaller ends of each housing being of like size and configuration for mating with one another. Charcoal or other suitable solid fuel can be placed into either housing which functions as a firebox or heat generating chamber. The entire stove structure is demountable and nestable for ease of storage and transportation.

Applicant is also aware of U.S. Pat. No. 4,909,235 to Boetcker which provides a cooking stove having a semi-conical outer housing and an inverted semi-conical firebox inserted therein. The firebox has a set of openings in its periphery towards the bottom portion thereof which is covered by a ring having similar openings which can be rotated to allow air to flow into the firebox or to prevent the flow of air into the firebox. The housing also has openings which allow air to flow into the area between the housing and the firebox. The interior of the firebox contains a fuel rack upon which fuel such as charcoal briquettes or the like may be placed and ignited. The fuel may be extinguished with the use of a snuffer plate placed into the firebox where the snuffer plate rim rests adjacent to the inside of the firebox in an airtight manner. The ring may then be rotated until the openings on the ring are misaligned with the openings of the firebox to prevent the flow or air into the firebox.

Applicant is further aware of U.S. Pat. No. 5,094,223 to Gonzalea which provides a wood burning portable fire pit grill apparatus having a fire bowl base, a cylindrical wood receiving chamber defined by expanded metal walls above the fire bowl, a pair of separately controlled gas rings encircling the chamber adjacent its side wall at its bottom and middle, a propane gas tank releasably connected to the apparatus and gas rings via a flexible hose and manual quick release coupling. Wood pieces are stacked vertically into the chamber and thus inside the gas rings which, in use, project their flames horizontally toward the stacked wood pieces to advance their burning toward the hot coals state at which time the propane gas and hose may be disconnected and moved away. A removable cooking grill is atop the chamber for use in cooking off the hot coals fire which is achieved in less time than otherwise would be required in a conventional wood fire.

The problem with existing outdoor heating devices is that none of such devices provide a fuel efficient device that is self-extinguishable and collapsible for ease of transport. Therefore, an unaddressed need for an improved outdoor heating device exists to overcome the inadequacies and deficiencies in the prior art.

SUMMARY

It is an object of the present invention to provide a collapsible heating device that may be conveniently self-extinguished.

It is also an object of the present invention to provide a collapsible self-extinguishing heating device that efficiently burns solid fuel by exposing a greater amount of surface area for complete combustion.

It is a further object of the present invention to provide a portable self-extinguishing heating device that effectively controls the airflow such that the solid fuel may burn efficiently.

It is a further object of the present invention to provide a collapsible self-extinguishing heating device that may also be used as a means for cooking.

A collapsible self-extinguishing heating device for building a fire according to the present invention is provided wherein the heating device includes a canister defining a hollow cavity, the canister having an open end. A base corresponding to the canister is configured to mate with the open end of the canister so as to detachably close the open end of the canister. A perforated lower burner is supported on the base, the lower burner defining a hollow core. A perforated upper burner defining a hollow core is removably nestable within the hollow core of the lower burner. The upper burner is movable between a first collapsed position and a second operative position. The upper burner is disposed within the hollow core of the lower burner when in the first collapsed and the upper burner is supported upright on the lower burner when in the second operative position. When the upper burner is in the first collapsed position, the canister may mate with the base to extinguish the fire.

BRIEF DESCRIPTION OF THE DRAWINGS

These and other objects of the invention will be apparent from the following detailed description of the invention and from the attached drawings of which.

DETAILED DESCRIPTION OF PREFERRED EMBODIMENTS

Figure 1:
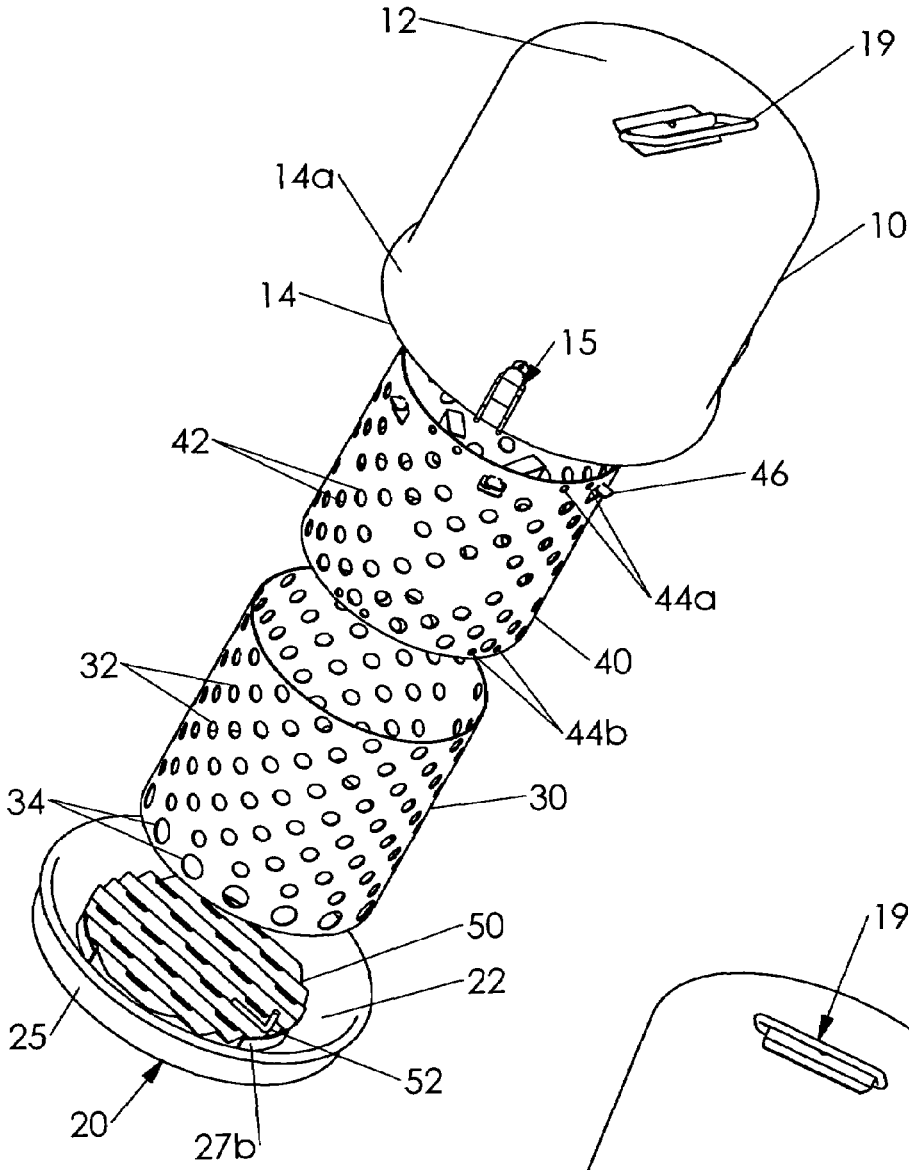
FIG. 1 is an exploded perspective view of an embodiment of the collapsible self-extinguishing heating device.
Figure 2:
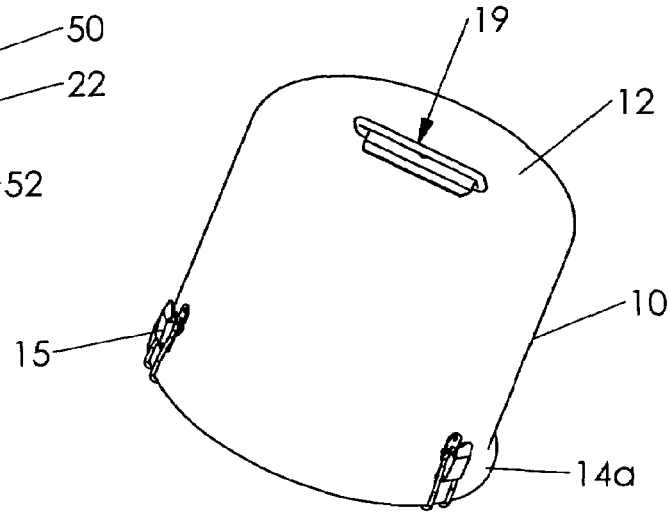
FIG. 2 is a perspective view of the heating device seen in FIG. 1 in a first collapsed position.

With reference to FIGS. 1 to 22, the heating device 1 for containing a fire according to the present invention includes a canister assembly 10 detachably securable to a canister base assembly 20 by way of conventional fastening means 15 such as, but not limited to, clasps, fasteners or locking mechanisms. When canister assembly 10 is mounted on and secured to canister base assembly 20, canister assembly 10 and canister base assembly 20 together form an enclosed housing, as seen in FIG. 2, wherein a lower burner unit assembly 30 and an upper burner unit assembly 40 may be removably contained within the housing, as seen in FIG. 1. Preferably, upper burner unit assembly 40 may be removably nestable within lower burner unit assembly 30. In an embodiment of the invention, heating device 1 may also include a cooking grill assembly 50 disposed within the housing.

Canister assembly 10 may be made of any rigid, durable, and strong material such as, but not limited to, steel, aluminum, and high strength plastic. Preferably, canister assembly 10 is made of 18-gauge steel and coated with a coating so as to lower the thermal conductivity of the steel. In an embodiment of the invention, canister assembly 10 may be porcelain coated or powder coated. As described in greater detail below, advantageously, when canister assembly 10 is mounted on canister base assembly 20 to extinguish the fire burning in heating device 1, heat transference to canister assembly 10 may be kept to a minimum such that heating device 1 may be safely handled and transported shortly after extinguishment.

Figure 3:
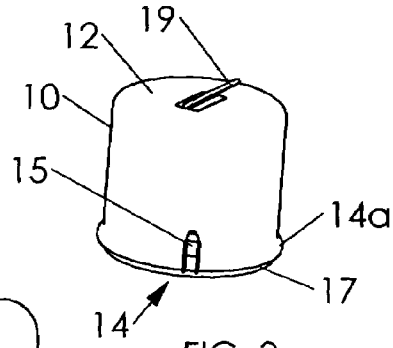
FIG. 3 is a perspective view of the heating device seen in FIG. 2 wherein the fastening means are released.
Figure 4:
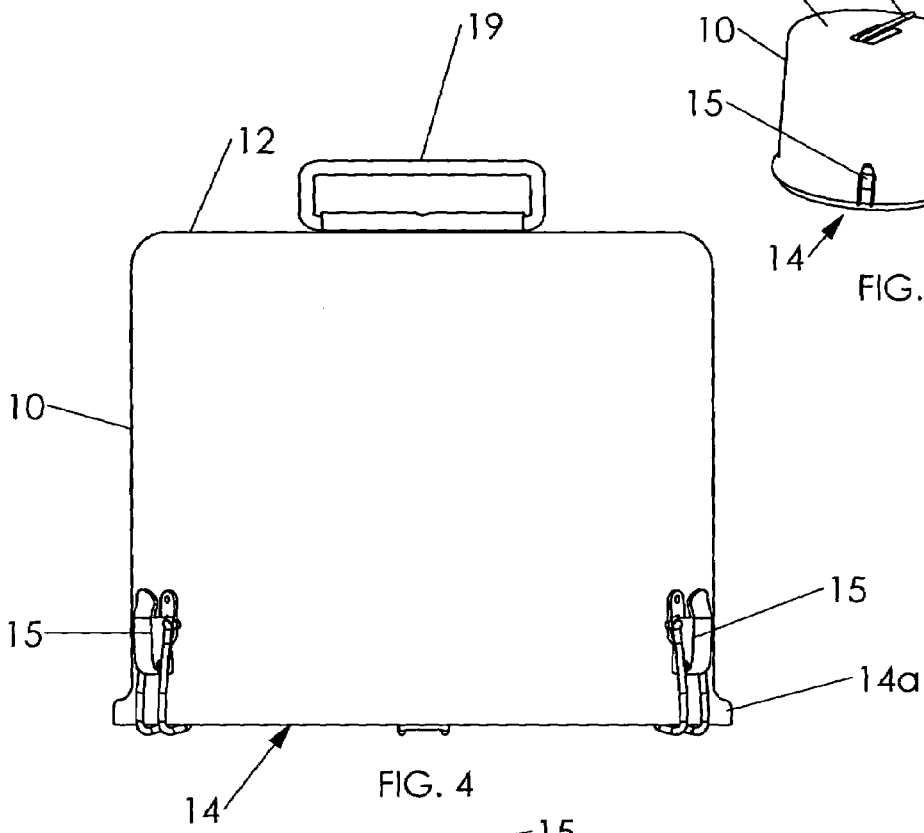
FIG. 4 is a front view of the heating device seen in FIG. 3.
Figure 5:
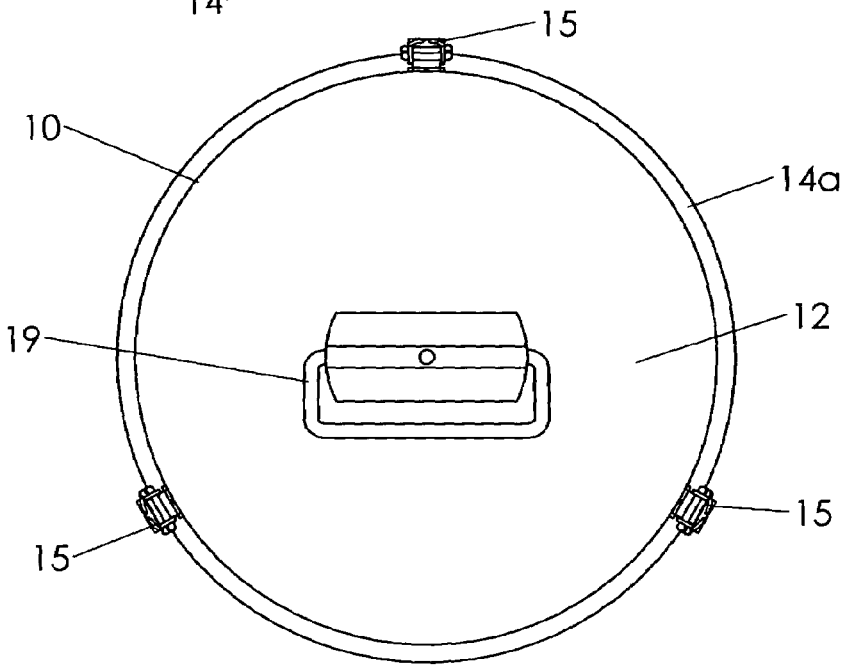
FIG. 5 is a top view of the heating device seen in FIG. 3.

In an embodiment of the invention, canister assembly 10 includes a generally cylindrical-shaped body having a closed first end 12 and an open second end 14, as seen in FIGS. 3 to 5. Canister assembly 10 thereby defines a hollow cavity that is enclosable when canister assembly 10 is mounted on canister base assembly 20. Although canister assembly 10 is described as being generally cylindrical, it will be understood that the invention has a wide range of applicability to other shapes and configurations. Open second end 14 is configured to engage and mate with canister base assembly 20 such that canister assembly 10 may be detachably secured onto canister base assembly 20 by way of fastening means 15. Preferably, fastening means 15 are catch mechanisms that frictionally engage canister base assembly 20 so as to secure canister assembly 10 on canister base assembly 20. Catch mechanisms 15 may be mounted circumferentially around open second end 14 on the outer surface of canister assembly 10. At least one catch mechanism 15 is mounted on canister assembly 10 although preferably, three catch mechanisms 15 are mounted on canister assembly 10.

In an embodiment of the invention, a lip 14*a* is formed around the circumferential edge of open second end 14. Lip 14*a* is of a size and configuration for mating with a corresponding annular rim portion 25 formed around the circumferential edge of canister base assembly 20, described in greater detail below. Lip 14*a* may include an annular gasket so as to affect a seal when canister assembly 10 is mounted on canister base assembly 20. Preferably, the gasket is made of high temperature silicone. In an alternative embodiment of the invention, open second end 14 includes an annular collar 17 attached to an inner surface of open second end 14, as seen in FIG. 3, such that when canister assembly 10 is placed on canister base assembly 20, annular collar 17 engages an inner surface of annular rim portion 25 so as to center and position canister assembly 10 on canister base assembly 20. Alternative means for mating canister assembly 10 with canister base assembly 20 are contemplated and within the scope of the present invention. A handle member 19 may be attached to canister assembly 10, preferably on the outer surface of closed first end 12, such that canister assembly 10 may be easily removed from and positioned on canister base assembly 20.

Canister base assembly 20 encloses the hollow cavity of canister assembly 10 when canister assembly 10 is mounted on canister base assembly 20. Canister base assembly 20 also acts as a support for lower burner unit assembly 30, as described in greater detail below. Similar to canister assembly 10, canister base assembly 20 may be made of any rigid, durable, and strong material such as, but not limited to, steel, aluminum, and high strength plastic. Preferably, canister base assembly 20 is made of the same 18-gauge steel coated with porcelain that canister assembly 10 is made of. As seen in FIGS. 6 to 11, in an embodiment of the invention, canister base assembly 20 includes a circular disk 22 having a diameter that substantially corresponds to the diameter of open second end 14 of canister assembly 10. Formed around the circumferential edge of disk 22 is annular rim portion 25 which is configured to mate with corresponding lip 14*a* of canister assembly 10.

Figure 6:
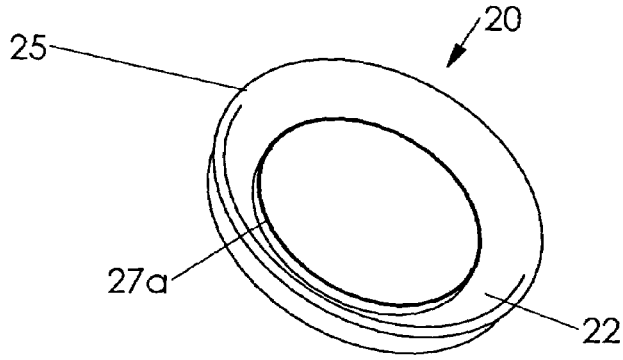
FIG. 6 is a perspective view of an embodiment of a canister base assembly.
Figure 7:
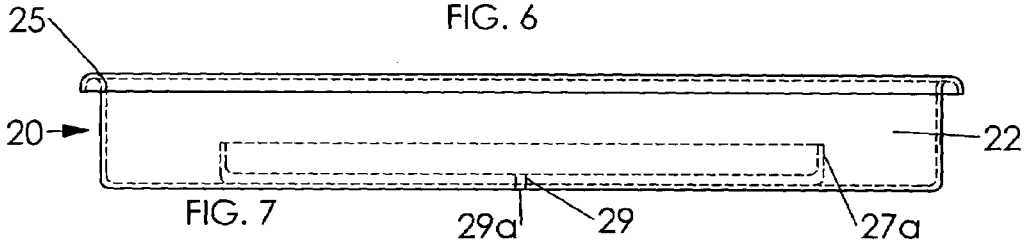
FIG. 7 is a cross sectional view of the canister base assembly of FIG. 6.
Figure 8:
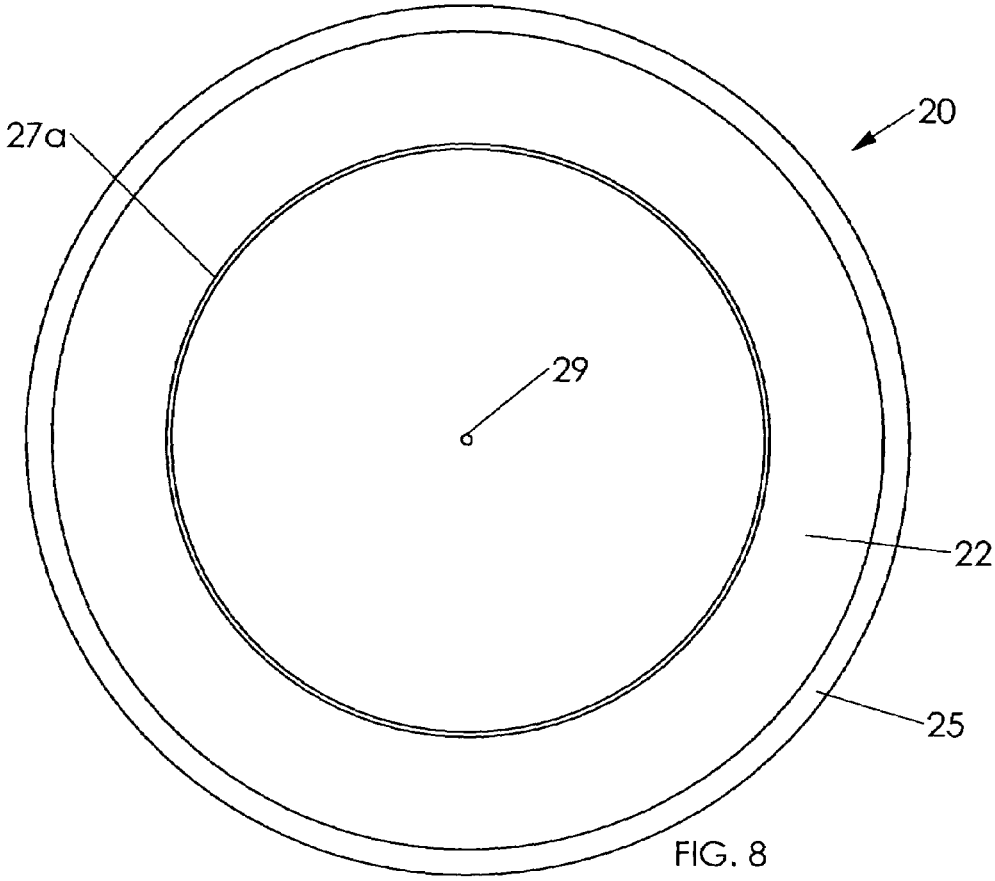
FIG. 8 is a top view of the canister base assembly of FIG. 6.
Figure 9:
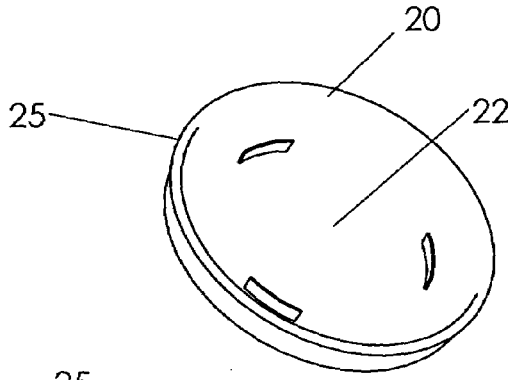
FIG. 9 is a perspective view of an alternative embodiment of the canister base assembly.
Figure 10:
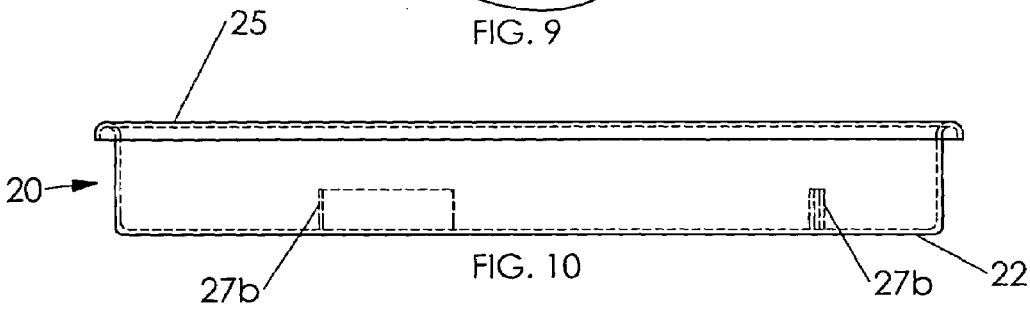
FIG. 10 is a cross sectional view of the canister base assembly of FIG. 9.
Figure 11:
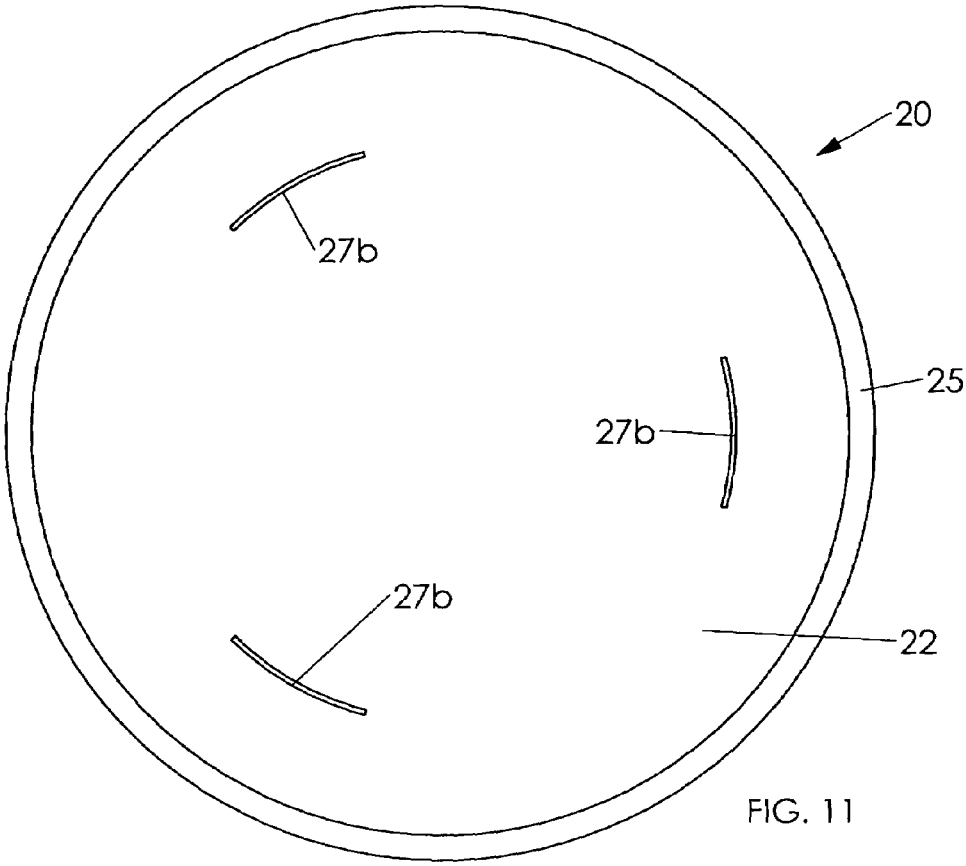
FIG. 11 is a top view of the canister base assembly of FIG. 9.

Canister base assembly 20 also includes a positioning means for positioning lower burner unit assembly 30 on canister base assembly 20. As seen in FIGS. 6 to 8, in an embodiment of the invention, the positioning means is a ring 27*a* mounted on disk 22 wherein ring 27*a* is of a size and configuration for mating with lower burner unit assembly 30 such that lower burner unit assembly 30 may rest centrally on disk 22 and be securely supported by canister base assembly 20. As seen in FIGS. 9 to 11, preferably, the positioning means are a plurality of tabs 27*b* mounted on disk 22 wherein tabs 27*b* are of a size and configuration for mating with lower burner unit assembly 30 so as to secure and maintain lower burner unit assembly 30 on disk 22, as seen in FIGS. 9 to 11. Disk 22 may also include an aperture 29 sealable with a removable cap 29*a* or other similar covering means such that any pressure that may build up within the enclosed housing of canister assembly 10 and canister base assembly 20 during the cool down period after the fire has been extinguished by mounting canister assembly 10 onto canister base assembly 20 may be exhausted from aperture 29 to prevent the formation of a vacuum.

Figure 13:
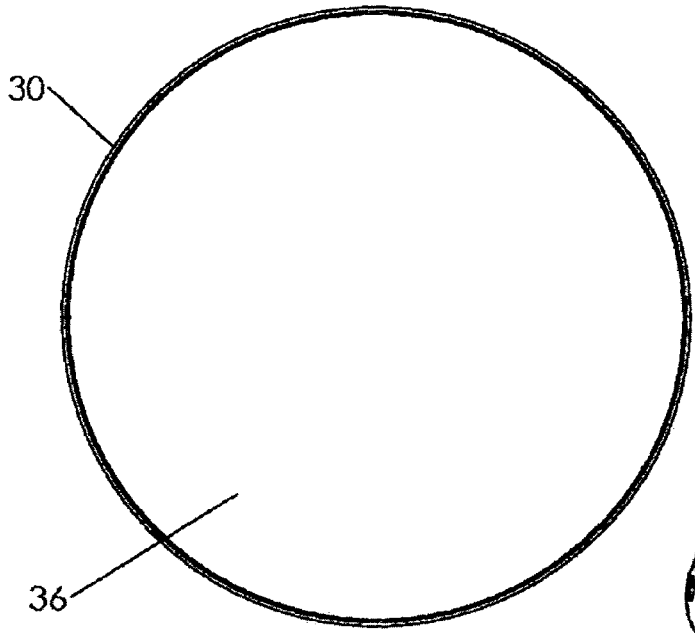
FIG. 13 is a top view of the lower burner unit assembly seen in FIG. 12.
Figure 12:
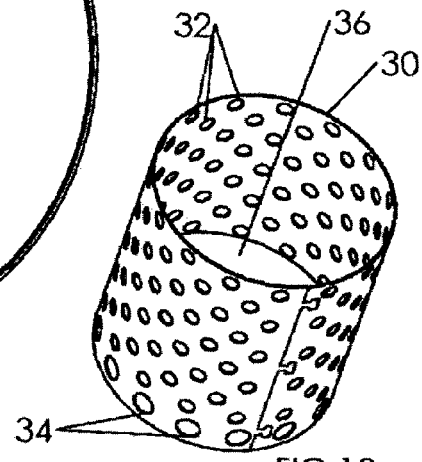
FIG. 12 is a perspective view of an embodiment of a lower burner unit assembly.
Figure 14:
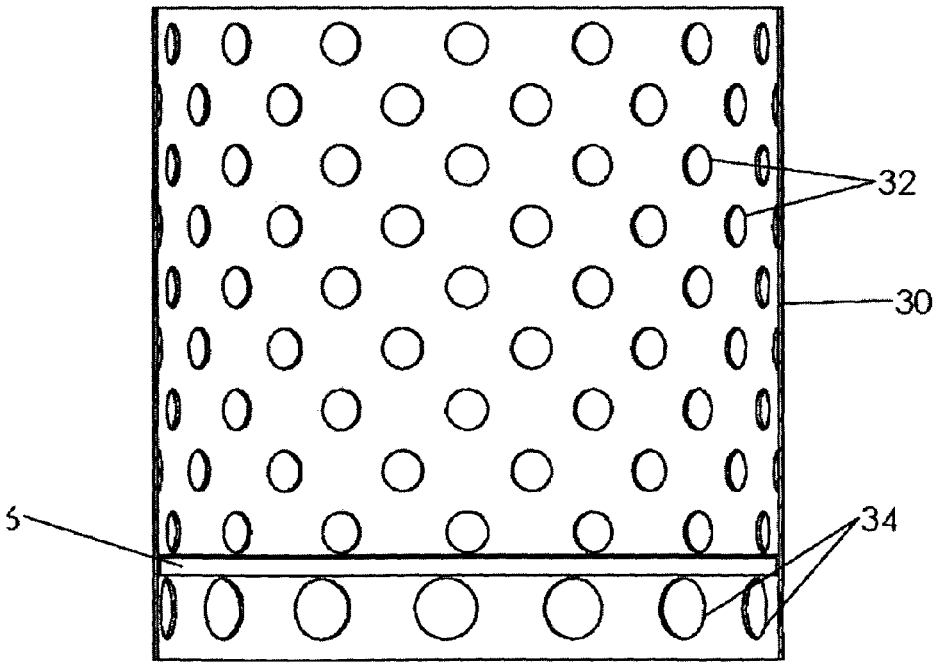
FIG. 14 is a cross sectional view of the lower burner unit assembly seen in FIG. 12.

In an embodiment of the invention, lower burner unit assembly 30 includes a generally cylindrical-shaped body which defines a hollow core, as seen in FIGS. 12 to 14. Preferably lower burner unit assembly 30 is made of the same 18-gauge steel as canister assembly 10 and canister base assembly 20. The diameter and height of lower burner unit assembly 30 is generally less than the diameter and height of canister assembly 10 such that lower burner unit assembly 30 may be contained within the enclosed housing formed when canister assembly 10 is mounted on canister base assembly 20. Lower burner unit assembly 30 defines a plurality of air intake apertures 32. In an embodiment of the invention, lower burner unit assembly 30 defines a predetermined number of air intake apertures 32, based on the diameter of lower burner unit assembly 30, such that the optimal amount of air may circulate through lower burner unit assembly 30. Air is comprised of primarily nitrogen and oxygen and the oxygen in the air is known as a supporter of combustion as it is necessary for combustion to occur. However, too much air will introduce too much nitrogen, which takes heat away from the fire causing it to be cooler and less stable and if there is too little air, some unburned fuel will escape and energy will be lost. As such, air intake apertures 32 provide a means for the optimal amount of oxygen to circulate into the hollow core of lower burner unit assembly 30 where the lower portion of the solid fuel is positioned so as sustain and complete combustion when the solid fuel is burning. Preferably, air intake apertures 32 are evenly spaced apart and measure 0.05 inches in diameter. In an embodiment of the invention, lower burner unit assembly 30 also defines a circumferential row of air flow apertures 34 around the base, generally immediately adjacent to canister base assembly 20 so as to allow air to flow between canister base assembly 20 and base plate 36 of lower burner unit assembly 30. Preferably, air flow apertures 34 are larger than air intake apertures 32 and measure 0.75 inches in diameter. In an embodiment of the invention, base plate 36 is mounted within the hollow core of lower burner unit assembly 30 above the row of air flow apertures 34 so as to close a lower end of lower burner unit assembly 30. Base plate 36 provides a lower base support for the solid fuel, such as firewood, when it is placed within lower and upper burner unit assemblies 30, 40. Alternatively, in the absence of base plate 36, the solid fuel may be supported directly on disk 22.

Figure 15:
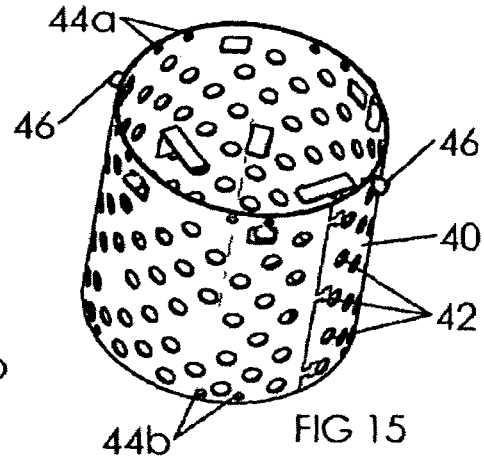
FIG. 15 is a perspective view of an embodiment of an upper burner unit assembly.
Figure 16:
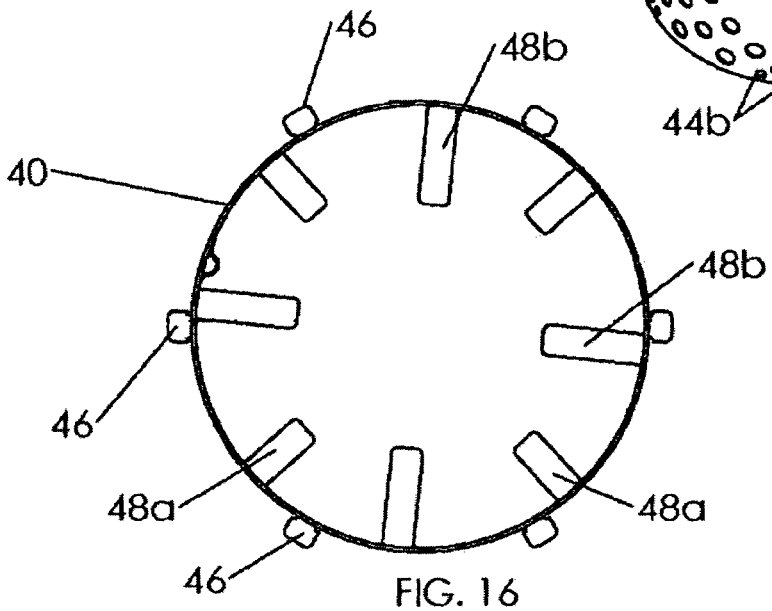
FIG. 16 is a top view of the upper burner unit assembly seen in FIG. 15.
Figure 17:
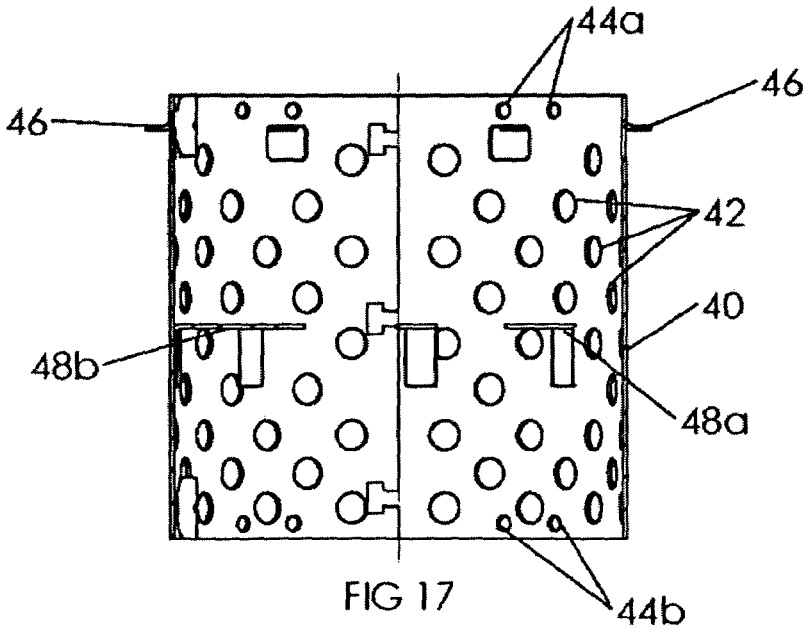
FIG. 17 is a cross sectional view of the upper burner unit assembly seen in FIG. 15.

Similar to lower burner unit assembly 30, upper burner unit assembly 40 includes a generally cylindrical-shaped body which defines a hollow core, as seen in FIGS. 15 to 17. Preferably, upper burner unit assembly 40 is made of the same 18-gauge steel as canister assembly 10, canister base assembly 20, and lower burner unit assembly 30. The diameter of upper burner unit assembly 40 is generally less than the diameter of lower burner unit assembly 30 such that upper burner unit assembly 40 may be disposed within lower burner unit assembly 30 and rest on base plate 36 or disk 22. For greater clarity, upper burner unit assembly 40 is removably nestable within the hollow core of lower burner unit assembly 30. The height of upper burner unit assembly 40 is also generally less than the height of canister assembly 10 such that when upper burner unit assembly 40 is disposed within lower burner unit assembly 30, both upper burner unit assembly 40 and lower burner unit assembly 30 may be substantially contained and secured within the enclosed housing formed when canister assembly 10 is mounted on canister base assembly 20 and secured together by fastening means 15. Upper burner unit assembly 40 also defines a plurality of air intake apertures 42. In an embodiment of the invention, upper burner unit assembly 40 defines a predetermined number of air intake apertures 42, based on the diameter of upper burner unit assembly 40, such that the optimal amount of air may circulate through upper burner unit assembly 40. As described above with respect to air intake apertures 32 of lower burner unit assembly 30, air intake apertures 42 of upper burner unit assembly 40 provide a means for the optimal amount of oxygen to circulate into the hollow core of upper burner unit assembly 40 where the upper portion of the solid fuel is positioned so as sustain and complete combustion when the solid fuel is burning. Preferably, air intake apertures 42 are evenly spaced apart and measure 0.05 inches in diameter.

Figure 18:
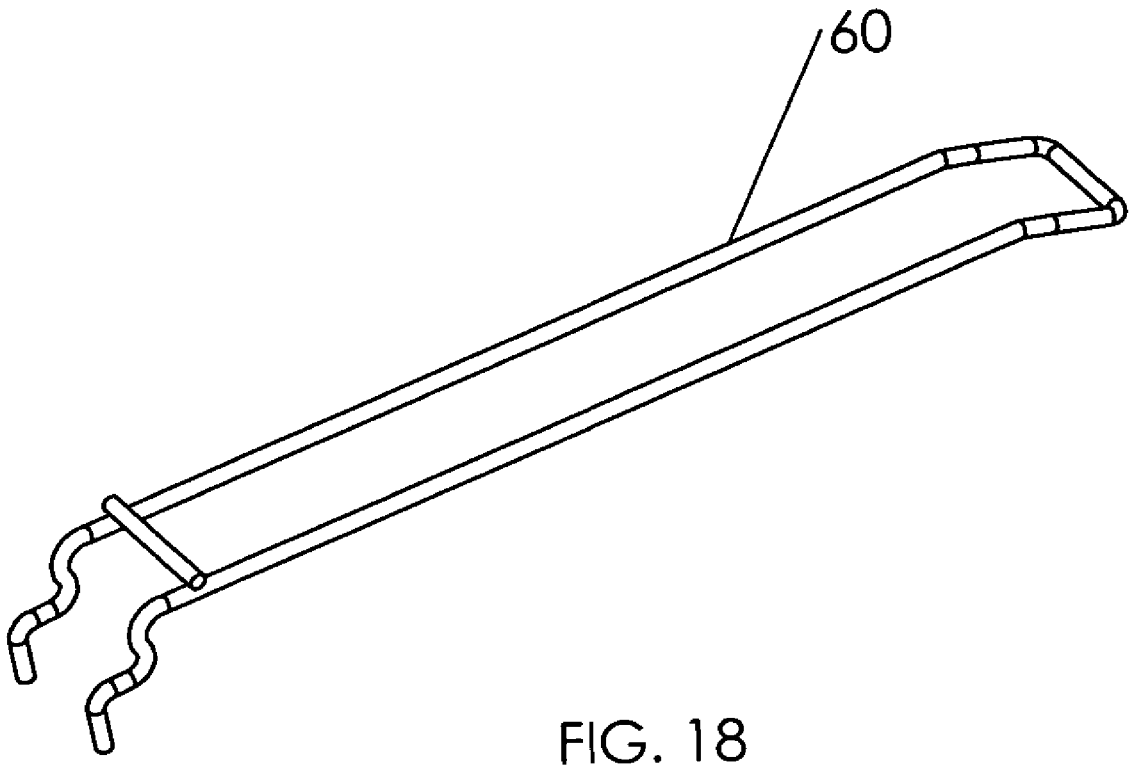
FIG. 18 is a perspective view of an embodiment of a handle.

As best seen in FIG. 17, at a first and a second end, upper burner unit assembly 40 defines at least one receiving means 44*a*, 44*b* on each end sized and configured to receive a detachable handle 60. In an embodiment of the invention, receiving means 44*a* and 44*b* is an aperture and handle 60 is a two-pronged handle, as seen in FIG. 18. When handle 60 is inserted in aperture 44*a*, 44*b*, handle 60 may be used to manipulate upper burner unit assembly 40 as described in greater detail below. At the first end of upper burner unit assembly 40 are support tabs 46. In an embodiment of the invention, support tabs 46 are formed at the first end of upper burner unit assembly 40 and extend outwards from and perpendicular to the outer surface of upper burner unit assembly 40. In the first collapsed position when upper burner unit assembly 40 is disposed within lower burner unit assembly 30, a first surface of support tabs 46 rest on an upper rim of lower burner unit assembly 30 while the cylindrical body of upper burner unit assembly 40 nests within the hollow core defined by the generally cylindrical-shaped body of lower burner unit assembly 30. In the second operative position when upper burner unit assembly 40 is removed from within the hollow core of lower burner unit assembly 30 and mounted on top of lower burner unit assembly 30 in an upright position to receive the solid fuel, upper burner unit assembly 40 is inverted such that a second opposing surface of support tabs 46 engage the upper rim of lower burner unit assembly 30 to support upper burner unit assembly 40 on lower burner unit assembly 30. Preferably, upper burner unit assembly 40 includes six support tabs 46.

Figure 20:
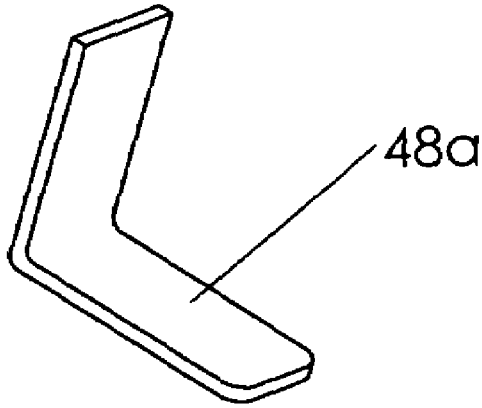
FIG. 20 is a perspective view of an embodiment of a short support finger for maintaining solid fuel in an upright vertical position within the upper and lower burner unit assembly.
Figure 21:
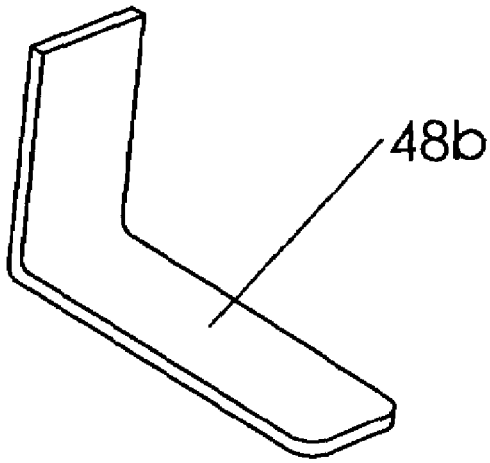
FIG. 21 is a perspective view of an embodiment of a long support finger for maintaining solid fuel in an upright vertical position within the upper and lower burner unit assembly.

Attached to the inner surface of upper burner unit assembly 40 within the hollow core defined by the generally cylindrical body of upper burner unit assembly 40 are a plurality of fingers 48*a*, 48*b*, as best seen in FIG. 16. Fingers 48*a*, 48*b* extend generally horizontally from and perpendicular to the inner surface of upper burner unit assembly 40. Fingers 48*a*, 48*b* support the solid fuel such that the solid fuel may be maintained in a generally upright and vertical position such that all surfaces of the solid fuel may be exposed for burning. Advantageously, because all sides of the fuel are exposed for combustion when in the upright vertical position, the increase in surface area available for combustion increases the burn efficiency of the fuel. In an embodiment of the invention, fingers 48*a* are short support fingers and fingers 48*b* are long support fingers, as seen in FIGS. 20 and 21. Preferably, upper burner unit assembly 40 includes eight fingers 48 wherein four are short support fingers 48*a* and four are long support fingers to accommodate the typical size of conventional manufactured fireplace fire logs such as those sold under the trademark DURAFLAME™.

Figure 19:
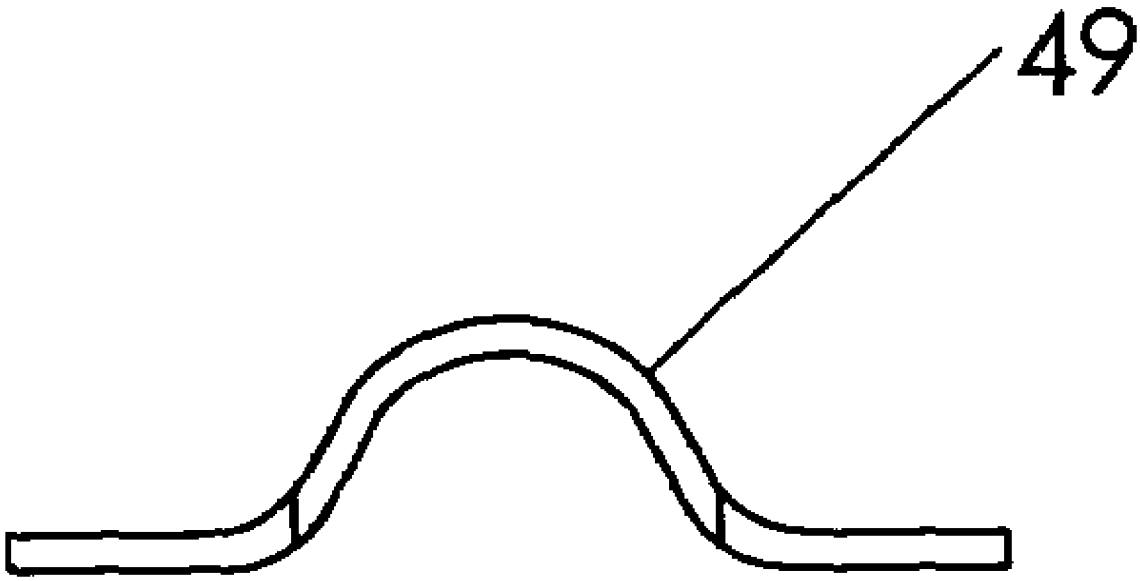
FIG. 19 is a top view of an embodiment of a support member for a cooking grill assembly.
Figure 22:
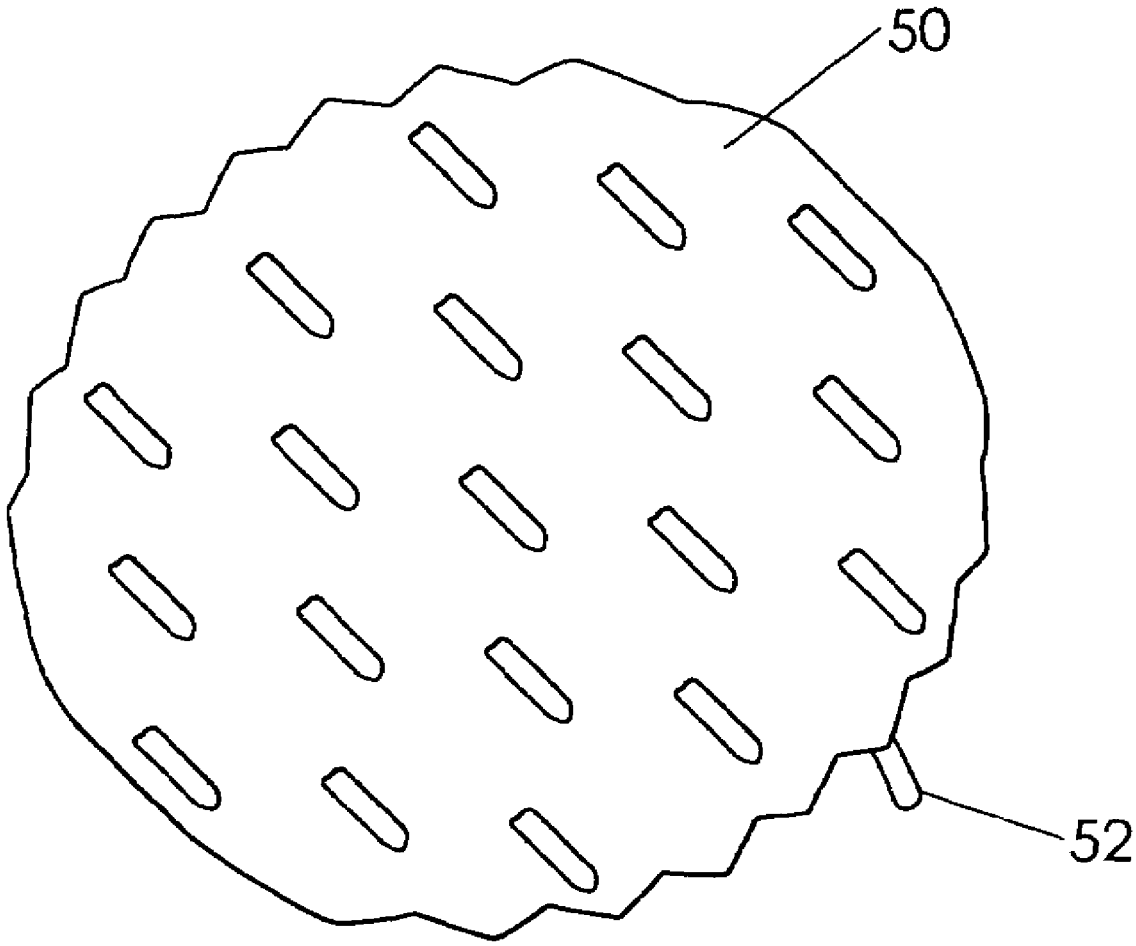
FIG. 22 is a perspective view of an embodiment of a cooking grill assembly.

In an embodiment of the invention, also attached to the inner surface of upper burner unit assembly 40 is at least one support member 49 for supporting cooking grill assembly 50. Cooking grill assembly 50 includes a circular grill sized and configured to be supported by and over upper burner unit assembly 40. Preferably, cooking grill assembly 50 includes a rod 52 that may be detachably attached perpendicular to the circular grill such that rod 52 may be inserted in support member 49 so as to support the circular grill over upper burner unit assembly 40, as seen in FIGS. 19 and 22. Cooking grill assembly 50 may also made of 18-gauge steel.

To assemble heating device 1 from the first collapsed position to the second operative position, fastening means 15 are released such that canister assembly 10 may be removed from canister base assembly 20, preferably by grasping canister assembly 10 by handle member 19. Upper burner unit assembly 40 may then be removed from its nesting position within lower burner unit assembly 30. With lower burner unit assembly 30 resting securely on positioning means 27 and supported by canister base assembly 20, upper burner unit assembly 40 may be inverted such that the second opposing surface of support tabs 46 may engage and rest on the upper rim of lower burner unit assembly 30 to support upper burner unit assembly 40 in the upright operative position. Solid fuel such as firewood or manufactured fireplace fire logs may be inserted through upper burner unit assembly 40 to rest on base plate 36 or disk 22. The solid fuel is maintained in a vertical upright position by fingers 48. Advantageously, because of the vertical position of the solid fuel, which increases the surface area available for burning and the optimal airflow permitted by air intake apertures 32, 42, heating device 1 efficiently burns the solid fuel.

To self-extinguish the fire, handle 60 is inserted in aperture 44*a* at the first end of upper burner unit assembly 40 such that upper burner unit assembly 40 may disengage and be lifted away from lower burner unit assembly 30. Upper burner unit assembly 40 may then be set down on the ground or any other surface such that handle 60 may be detached from aperture 44*a* and inserted in aperture 44*b* at the second end of upper burner unit assembly 40. Preferably, prior to extinguishing the fire, the solid fuel is no higher than the top edge of lower burner unit assembly 30 although the flames may burn above the top edge of lower burner unit assembly 30. Using handle 60, upper burner unit assembly 40 may be inverted such that upper burner unit assembly 40 may be returned to the collapsed first position wherein the cylindrical body of upper burner unit assembly 40 is disposed within the hollow core defined by the cylindrical body of lower burner unit assembly 30. Canister assembly 10 may then be positioned on canister base assembly 20 using handle 19 and secured on canister base assembly 20 by securing fastening means 15. Advantageously, by securing canister assembly 10 on canister base assembly 20, the fire may be self-extinguished due to the lack of oxygen to feed the flame.

As will be apparent to those skilled in the art in light of the foregoing disclosure, many alterations and modifications are possible in the practice of this invention without departing from the spirit or the scope thereof. Accordingly, the scope of the invention is to be construed in accordance with the substance defined by the following claims.

What is claimed is:

1. A heating device for containing a fire, said heating device comprising:

a) a canister defining a hollow cavity, said canister having an open end and a closed end;

b) a base corresponding to said canister, said base configured to mate with said open end of said canister so as to detachably close said open end;

c) a perforated lower burner positioned on said base, said perforated lower burner defining a hollow core; and d) a perforated upper burner defining a hollow core, said perforated upper burner removably nestable within said hollow core of said perforated lower burner;

wherein said perforated upper burner is movable between a first collapsed position and a second operative position, said perforated upper burner disposed within said hollow core of said perforated lower burner when in said first collapsed position, and said perforated upper burner being supported on said perforated lower burner when in said second operative position; and wherein when said perforated upper burner is in said first collapsed position, said canister may mate with said base to extinguish the fire.

2. The heating device of claim 1 further comprising a plurality of fingers mounted to said perforated upper burner within said hollow core of said perforated upper burner, said plurality of fingers extending horizontally from and perpendicular to said perforated upper burner to support the solid fuel an upright position.

3. The heating device of claim 2 wherein said perforated upper burner further comprises a plurality of air intake apertures of a predetermined size, said plurality of air intake apertures equally spaced apart such that an optimal amount of air may circulate through said perforated upper burner.

4. The heating device of claim 3 wherein said perforated lower burner further comprises a plurality of air intake apertures of a predetermined size, said plurality of air intake apertures equally spaced apart such that an optimal amount of air may circulate through said perforated lower burner.

5. The heating device of claim 4 wherein said perforated upper burner comprises support members mounted to a first end of said perforated upper burner, said support members configured to support said perforated upper burner on said perforated lower burner.

6. The heating device of claim 5 wherein said perforated upper burner further comprises at least one receiving means at a first and a second end of said perforated upper burner, said at least one receiving means configured to receive a handle.

7. The heating device of claim 6 wherein said perforated lower burner comprises a base plate at a first end of said perforated lower burner, said base plate supporting a lower portion of the solid fuel within said hollow core of said perforated lower burner.

8. The heating device of claim 7 wherein said base comprises a positioning means for positioning said perforated lower burner on said base.

9. The heating device of claim 8 wherein said canister comprises at least one fastening means for detachably securing said canister on said base.

10. The heating device of claim 9 further comprising a grill detachably mountable on said perforated upper burner.

11. A solid fuel burning device comprising:

a) a cylindrical canister defining a hollow cavity, said canister having an open end and a closed end;

b) a base corresponding to said canister, said base configured to mate with said open end of said canister so as to detachably close said open end;

c) a perforated lower burner positioned on said base, said perforated lower burner defining a hollow core and a plurality of air intake apertures of a predetermined size, said plurality of air intake apertures equally spaced apart such that an optimal amount of air may circulate through said hollow core of said perforated lower burner;

d) a perforated upper burner defining a hollow core and a plurality of air intake apertures of a predetermined size, said plurality of air intake apertures equally spaced apart such that an optimal amount of air may circulate through said hollow core of said perforated upper burner, said perforated upper burner removably nestable within said hollow core of said perforated lower burner;

e) support members mounted to a first end of said perforated upper burner, said support members configured to support said perforated upper burner on said perforated lower burner; and f) a plurality of fingers mounted to said perforated upper burner within said hollow core of said perforated upper burner, said plurality of fingers extending horizontally from and perpendicular to said perforated upper burner to support a solid fuel in an upright position;

wherein said perforated upper burner is movable between a first collapsed position and a second operative position, said perforated upper burner disposed within said hollow core of said perforated lower burner when in said first collapsed position and said support members resting on said perforated lower burner so as to support said perforated upper burner on said perforated lower burner when in said second operative position; and wherein when said perforated upper burner is in said first collapsed position, said canister may mate with said base.

12. The heating device of claim 11 wherein said perforated upper burner further comprises at least one receiving means at a first and a second end of said perforated upper burner, said at least one receiving means configured to receive a handle.

13. The heating device of claim 12 wherein said perforated lower burner comprises a base plate at a first end of said perforated lower burner, said base plate supporting a lower portion of the solid fuel within said hollow core of said perforated lower burner.

14. The heating device of claim 13 wherein said base comprises a positioning means for positioning said perforated lower burner on said base.

15. The heating device of claim 14 wherein said canister comprises at least one fastening means for detachably securing said canister on said base.

16. The heating device of claim 15 further comprising a grill detachably mountable on said perforated upper burner.

17. A method of extinguishing a fire burning in a heating device for containing a fire, the method comprising the steps of:

a) providing a canister defining a hollow cavity, said canister having an open end and a closed end;

b) providing a base corresponding to said canister, said base configured to mate with said open end of said canister so as to detachably close said open end;

c) providing a perforated lower burner positioned on said base, said perforated lower burner defining a hollow core;

d) providing a perforated upper burner defining a hollow core, said perforated upper burner movable between an operative position, wherein said perforated upper burner is removably supported on said perforated lower burner, and a collapsed position, wherein said perforated upper burner removably nestable within said hollow core of said perforated lower burner;

e) removing said perforated upper burner from said perforated lower burner while the fire is burning;

f) nesting said perforated upper burner within said hollow core of said perforated lower burner; and g) mating said open end of said canister with said base so as to inhibit flow of oxygen to the fire.

18. The method of claim 17 wherein said perforated upper burner further comprises a plurality of fingers mounted to said perforated upper burner within said hollow core of said perforated upper burner, said plurality of fingers extending horizontally from and perpendicular to said perforated upper burner to support a solid fuel in an upright position.

19. The method of claim 18 wherein said perforated upper burner further comprises a plurality of air intake apertures of a predetermined size, said plurality of air intake apertures equally spaced apart such that an optimal amount of air may circulate through said perforated upper burner.

20. The method of claim 19 wherein said perforated lower burner further comprises a plurality of air intake apertures of a predetermined size, said plurality of air intake apertures equally spaced apart such that an optimal amount of air may circulate through said perforated lower burner.

* * * * *